US005879275A

United States Patent [19]

Aruin

[11] Patent Number: 5,879,275

[45] Date of Patent: Mar. 9, 1999

[54] LEG EXERCISER AND METHOD

[76] Inventor: Alexander S Aruin, Two Wheaton Center #312, Wheaton, Ill. 60187

[21] Appl. No.: 903,650

[22] Filed: Jul. 31, 1997

Related U.S. Application Data

[60] Provisional application No. 60/023,212 Aug. 2, 1996.

[51] Int. Cl.[6] ..... A63B 22/14

[52] U.S. Cl. ..... 482/146; 482/147

[58] Field of Search ..... 482/71, 146, 147; 434/253

[56] References Cited

U.S. PATENT DOCUMENTS

| | | | |
|---|---|---|---|
| 3,108,802 | 10/1963 | Sundquist | 482/146 |
| 3,207,510 | 9/1965 | Gibson | 482/71 |
| 3,441,271 | 4/1969 | Palacios | 482/146 |
| 3,582,066 | 6/1971 | Keryluk | 482/71 |
| 3,612,519 | 10/1971 | Larson | 482/147 |
| 3,911,907 | 10/1975 | Smith, Jr. | 482/147 X |
| 4,220,329 | 9/1980 | Agyagos | 482/147 |
| 4,319,749 | 3/1982 | Agyagos | 482/147 |
| 4,515,363 | 5/1985 | Schleffendorf | 482/146 X |
| 4,629,181 | 12/1986 | Krive | 482/146 X |
| 5,078,389 | 1/1992 | Chen | 482/71 X |
| 5,632,711 | 5/1997 | Hwang | 482/146 X |
| 5,730,690 | 3/1998 | Guidry | 482/146 |

FOREIGN PATENT DOCUMENTS

| | | | |
|---|---|---|---|
| 1583-114-A | 8/1990 | U.S.S.R. | 482/147 |

*Primary Examiner*—Richard J. Apley
*Assistant Examiner*—William LaMarca

[57] ABSTRACT

A leg exerciser includes two turning disks removable united with the base plate and supplied with adjustable resistance elements, electronic module to measure weight distribution, and stabilizing elements. The base plate furnishes a plurality of horizontal, vertical, and angular positions of each disk providing symmetrical weight bearing of the user imparting rotary movements of each leg independently against resistance.

11 Claims, 5 Drawing Sheets

LEG EXERCISER AND METHOD

CROSS-RELATED TO RELATED APPLICATION

Not Applicable

STATEMENT REGARDING FEDERALLY SPONSORED RESEARCH OR DEVELOPMENT

Not Applicable

REFERENCE TO A MICROFICHE APPENDIX

Not Applicable

This application claims the benefit of the filing date of the provisional application #60-023212, which was filed on Aug. 2, 1996.

BACKGROUND OF THE INVENTION

This invention is relative to a device for exercising muscles of either one or both feet, ankles and lower legs of a patient or an athlete. More specifically it relates to an exerciser which permits the patient or an athlete to stand on one or two rotating platforms and manipulate the platforms so as to exercise the lower extremities against a resistance.

BRIEF SUMMARY OF THE INVENTION

The human lower extremities comprise a great number of interconnected bones, muscles, ligaments, tendons and cartilage. This complex combination results in a number of joints capable of moving in a wide range of directions. However, the mobility of joints, muscle force, and elasticity of tendons decrease with age, disease, injury, etc.

Doctors, physical therapists, and athletic trainers suggest a variety of different exercises to strengthen the lower extremities, to increase the force of muscle, mobility of joints, and ability to tolerate stress. This is particularly important while restoration of muscle function lost as a result of neurological disease. For example, stroke patients typically have weak leg muscles resulting in impossibility keeping a proper position for their paretic foot. They use the nonparetic leg for safety and speed resulting in disuse of the paretic leg or use the paretic leg as a "passive support" leading to an asymmetry of bipedal stance and gait. As a result stroke patients frequently have difficulty in walking, which is very important for functional independence.

Various devices have been designed to resist lower extremities through a range of motion. However, most of these devices can provide resistance in movement in only one direction, or if they can resist several directions of movement, are cumbersome to use and difficult to adjust to a particular exercise protocol. Most prior art devices lack adequate range of rotation motions, do not direct to improvement of symmetry of bipedal stance and gait, do not permit exercising of leg muscle to overcome learned disuse of the weaker leg.

The present invention is directed to provide an exercise device for increase of strength of muscles and joint mobility by exercising and rehabilitating of the lower extremities that overcomes the problems as set forth above.

The device forces greater "involvement" of the weaker lower extremity, helps to overcome the learned disuse of the weaker leg, and helps to prolong therapy beyond the usual therapy hours at the home setting.

The device develops an improved sense of balance in anyone who uses it, and is particularly helpful in developing a sense of balance for activities such as skiing. The unique motion associated with the invention causes the lower body to move relative to the upper body, similar to the motion experienced in downhill skiing, and enables the user to practice maintaining his (or her) body in a corresponding position despite wide range movement of the ankle, knee, and hips. Because it causes the muscles in the legs to flex and contract, it tends to strengthen and develop these muscles after only a relatively short period of usage.

The device may be used at the home, hospital, health club, office, school gym or outdoors, depending upon the purpose and result desired. It occupies relatively little space and can be operated quietly. It is also an attractive toy for children, and the basic technique of its use becomes immediately apparent to children even at the pre-school age level.

A number of devices are known which may be utilized in the performance of leg exercises. U.S. Pat. No. 5,256,127 which includes a base disk and rotation disk on which user's feet are positioned. This device provides the rotation displacements of the disk leftwards and rightwards for a short span in a reciprocating pattern by the user's feet, which affects the leg exercise. However the device cannot be used for exercise of each leg separately.

U.S. Pat. No. 4,705,272 is comprised of a supporting plate which provides space for two feet and is equipped with horizontally ratable elements. This device provides rotational exercises for only one leg.

U.S. Pat. No. 4,290,601 has a circular wobble plate centrally mounted to a base plate via a spherical bearing, and a roller assembly, which is located between wobble, and base plates. When a person stands on the wobble plate and shifts his/her weight relative to the baseboard center point, a rotation motion is imparted to the roller assembly. However this devise provides exercises only for one foot and is complicated to use.

For background purpose and as indicative of the art to which the invention relates references may be made to the following remaining patents found in the search:

| U.S. Pat. No. | Inventor | Issues |
|---|---|---|
| 3,100,639 | Everett D. Bonewits | Aug. 13, 1963 |
| 3,454,273 | Edwin M. Vogt | July, 1969 |
| 4,629,181 | Irwin Krive | July 21, 1983 |
| 4,291,873 | J. W. Lee | Sept. 29, 1981 |

As such, a need exists for an exerciser which has the versatility to enable a user to perform a broad range of leg exercises, including binding, flexing, extending, and rotating movements while varying the weight of the user's body applied to each feet.

The present invention can provide a wide spectrum of motions with different ranges of initial angles in joints, different distances between feet, and different vertical and angular feet positioning which, for example, imitate positioning of a person on the mountain slope during downhill skiing. The device provides exercises directed to improvement of weight bearing. The device may be easily adjusted to variations in age, size, training level, and medical condition of the individual. The present invention can provide the natural motions, which lead to rhythmic movements, involving the whole body from the neck and shoulders through the torso, down the thighs and calves to the feet. Such movements provide exercise effects on ankles, knees and hips, in particular, strengthening of ankle joint muscles, increasing tendon strength, and burning a lot of calories per hour, while improving balance and agility, and quickness and timing. The invention does a superb job of improving of weight bearing and cardiovascular conditioning. In addition, the use of this device increases venous leg circulation. The present device can be used for physical therapy, full training, conditioning, as well as for rehabilitation of injured leg joints, fitness and body fat reducing programs, and for aerobic exercises.

It is an object of this invention to design a simple apparatus for exercising of leg muscles by providing dynamic movement in either of a subject's legs including rotation of lower extremities, eversion, and inversion of feet, as well as rhythmic movements of the body, etc.

It is also an object of this invention in which such apparatus can be adjusted to give increased resistance against leg movements, increased initial inversion or eversion of feet, increased distance between feet, and increased initial vertical and angular position for each foot.

It is also an object of this invention to help to reduce motor disability in neurologically (e.g. stroke) impaired patients by providing a method and device for improvement weight bearing.

It is another objective of the invention to include an embodiment of the exerciser formed with electrical sensor connectable by a suitable electrical interface to a monitor to display output of the sensors in response to weight distribution.

It is also an object of this invention in which such apparatus provides vestibular training.

It is also an object of this invention in which such apparatus provides massage of the user's feet.

It is also an object of this invention that such apparatus is lightweight and is hand portable.

BRIEF DESCRIPTION OF THE SEVERAL VIEWS OF THE DRAWING

Related objects and advantages of the present invention will become even more apparent by reference to the following figures and detailed description in which similar reference characters refer to similar parts, and in which.

DETAILED DESCRIPTION OF THE INVENTION

Figure 1:
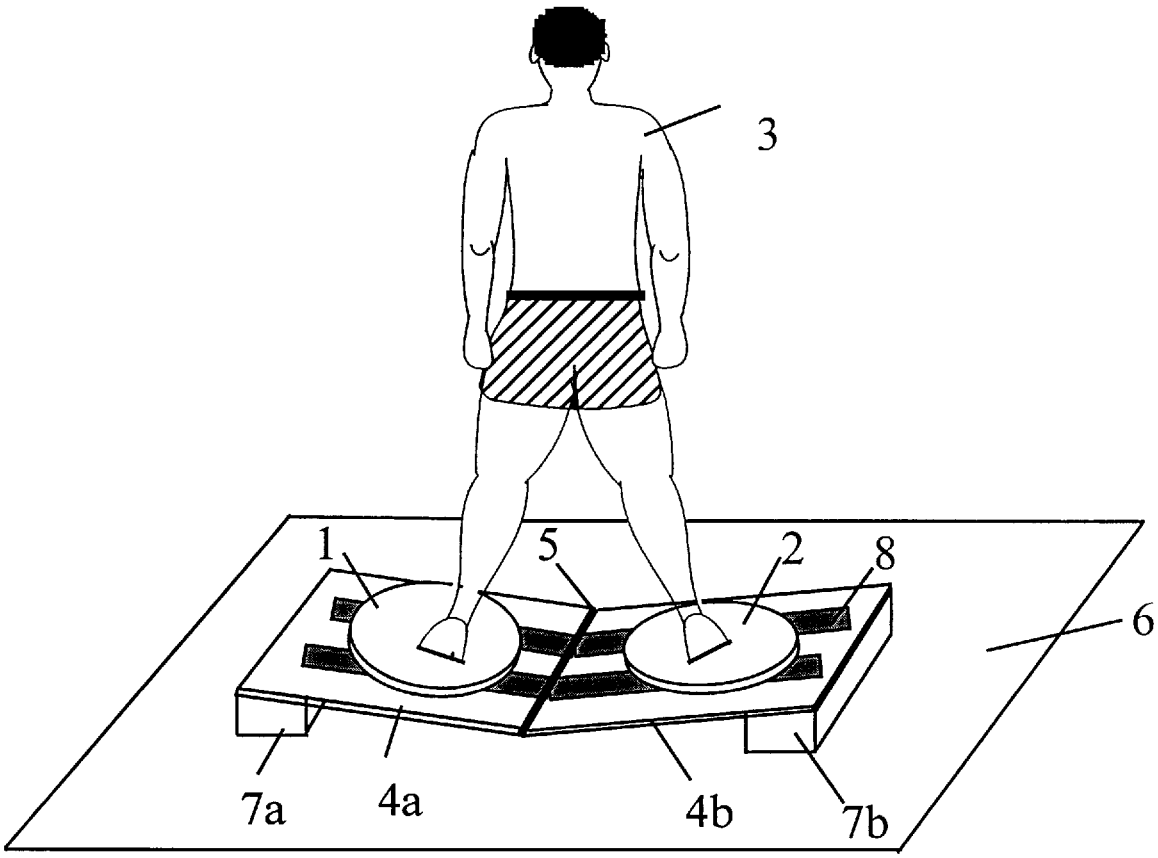
FIG. 1 is a perceptive view of the leg exerciser in a concave position as used by patient.
Figure 2:
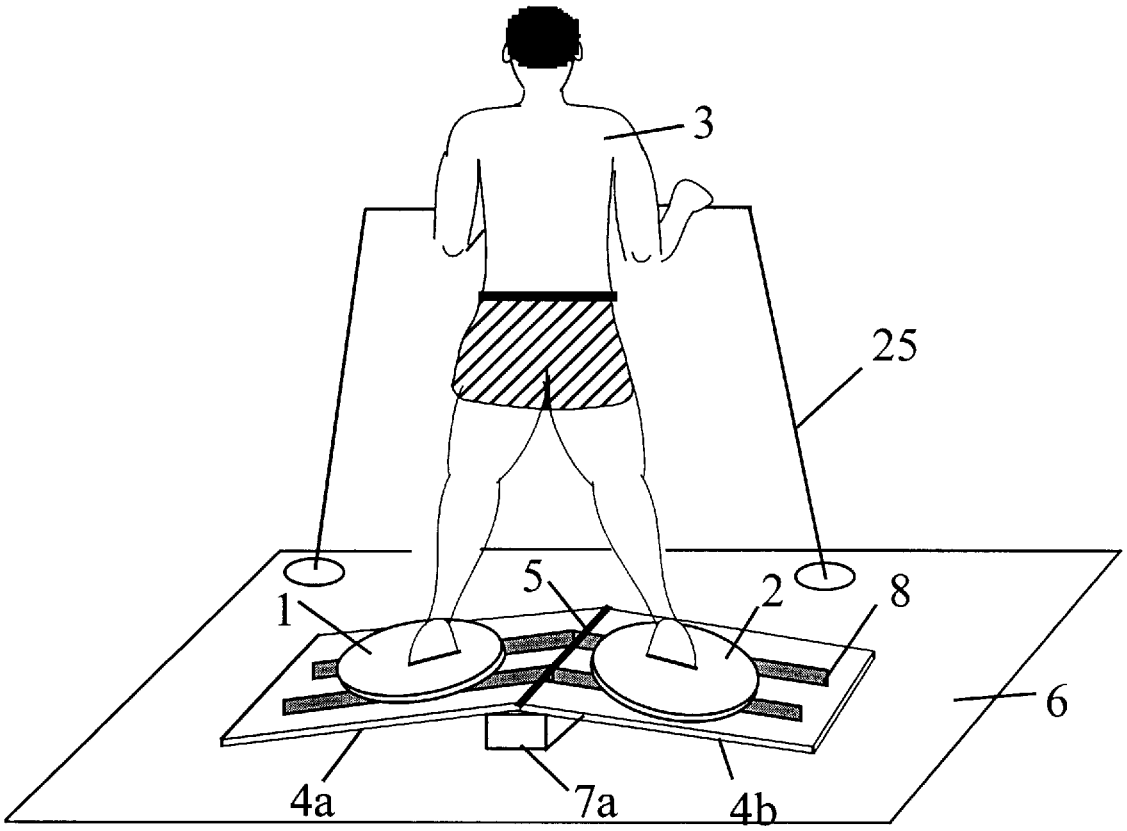
FIG. 2 is a view similar to FIG. 1, but showing the device in a bulging position.
Figure 3:
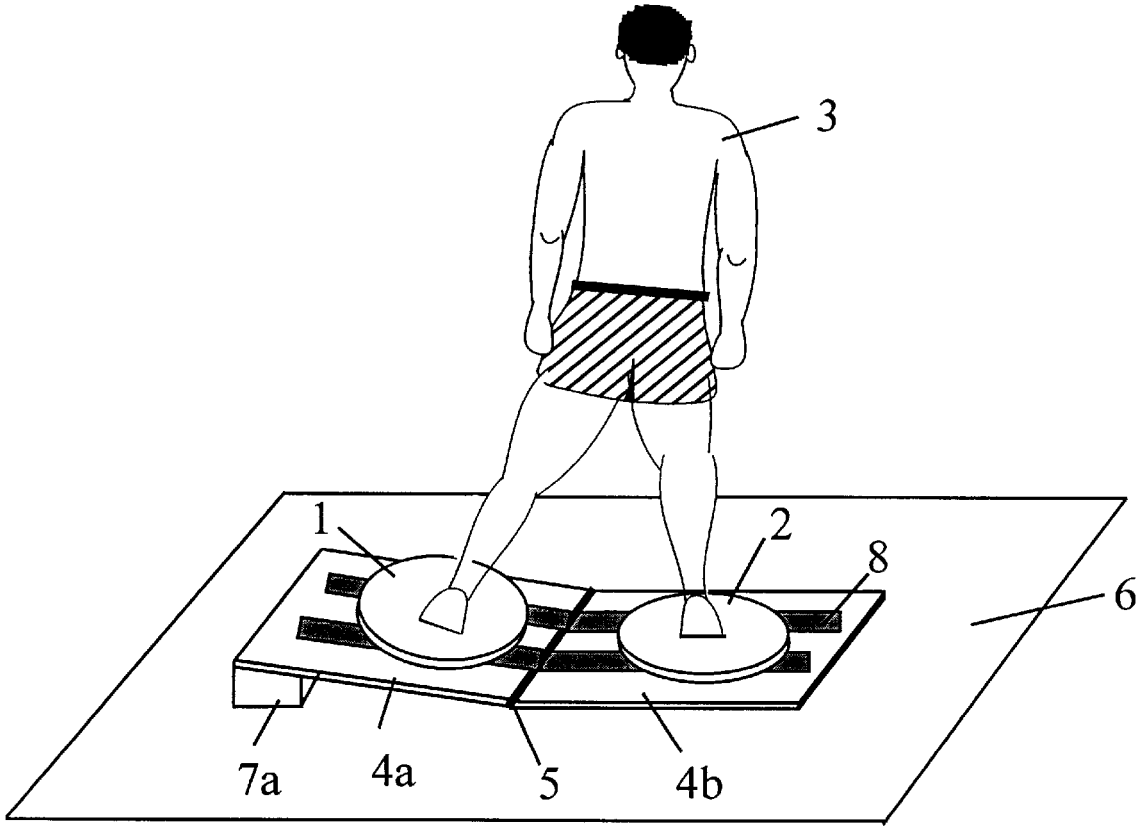
FIG. 3 is a perspective view of the exerciser as used by a patient for compelled weight bearing.

The leg exercises shown in FIGS. 1. 2, 3, consist of two turning disks 1 and 2 which are supported on the base plate 4 with a connecting elements 8. Said base plate 4 includes two movable parts 4*a,* 4*b* joined with a hinge 5. Said base plate 4 positioned on the floor 6 directly or via supports 7*a* and 7*b*. Different positions of supports 7*a* and 7*b* provide different variants of placement of said base plate 4 and as a result different positioning of the tuning disks 1, 2. While ends of the base plate 4 are positioned on supports 7*a* and 7*b,* the middle part of the plate 4 is positioned on the floor 6 the device is in a concave mode (FIG. 1). While ends of the base plate 4 are positioned on the floor 6 and the middle part of the base plate 4 is positioned on either one or both supports 7*a* and 7*b,* the device is in a bulging mode (FIG. 2). While one end 4*a* of the base plate 4 is positioned on one support 7*a* and the other part 4*b* of the base plate 4 is positioned on the floor 6, the device is in compelled weight bearing mode (FIG. 3). It is further understood that any other modes of exerciser are possible. For example, when one side of the base plate 4 (which is perpendicular to the hinge 5) is positioned on supports 7*a* and 7*b* and the other, opposite side of the base plate 4, is positioned on the floor 6, initial position of both heels of the user 3 will be elevated.

The distance of said supports 7*a,* 7*b* from the middle of the base plate 4 (or from hinge 5) influences the slope of the base plate 4. Said base plate 4 may be movably united with supports 7*a* and 7*b,* each of said supports 7*a,* 7*b* may consists of two parts united and supported by spring or bolts (not shown). Screw up said bolts change the size of the supports 7*a* or 7*b* providing elevation or putting down said base plate 4. Supports 7*a* and 7*b* are covered by anti-slip safety material or by any material (including Velcro tape) providing a firm connection between the floor 6 and base plate 4 or other parts of the exerciser to insure safety.

For the purpose of physical therapy and rehabilitation of persons with one weak leg, for example, for stroke patients, the compelled weight bearing mode is used (FIG. 3). Elevation of only one leg produce shift of the weight of the user's body towards the leg positioned on the disk 2. Exercising in such a more symmetrical in terms of weight bearing position, will help the user to overcome learned disuse of the weaker leg. Different levels of weight bearing may be achieved by adjusting the position of the supports 7*a,* 7*b*. Similar effect could be achieved while one disk, for example, disk 2 maybe positioned on the floor 6 without using the base plate 4, while the other disk 1 is positioned on the base plate 4.

Said turning disks 1 and 2 may be positioned directly on the floor 6 without using the base plate 4. They also may be positioned on a support having special shape (not shown), e.g. a wedge shape, with different orientation of said support relative to the initial position of a user's foot. A variety of replaceable supports having different sizes and different configurations may be used providing a plurality of positions of the user's feet.

One turning disk, for example 1 could be positioned on the floor near a stairs, while the other, disk 2 is positioned on the first step of the stairs (not shown). Both disks could be positioned on different steps of the stairs. The leg of the user 3, which is positioned on the elevated disk maybe slightly flexed to adjust the difference in vertical positions of both disks. Exercising in such a position imitate the position of the user 3 on the mountain slop. Banisters may be used while it is needed to keep balance.

Each of said turning disks 1 and 2 may be positioned on a special base (not shown) having a split ball which will provide a different range of orientation of each of disks 1 and 2 in space.

It is further understood that any combinations of lift, inclination, and orientation of the base plate 4 positioned on the floor 6 and said supports 7*a, b* are possible. These provide different initial angles in joints of the body, involve different range of movements in said joints, and provide adjusted weight bearing.

Figure 4:
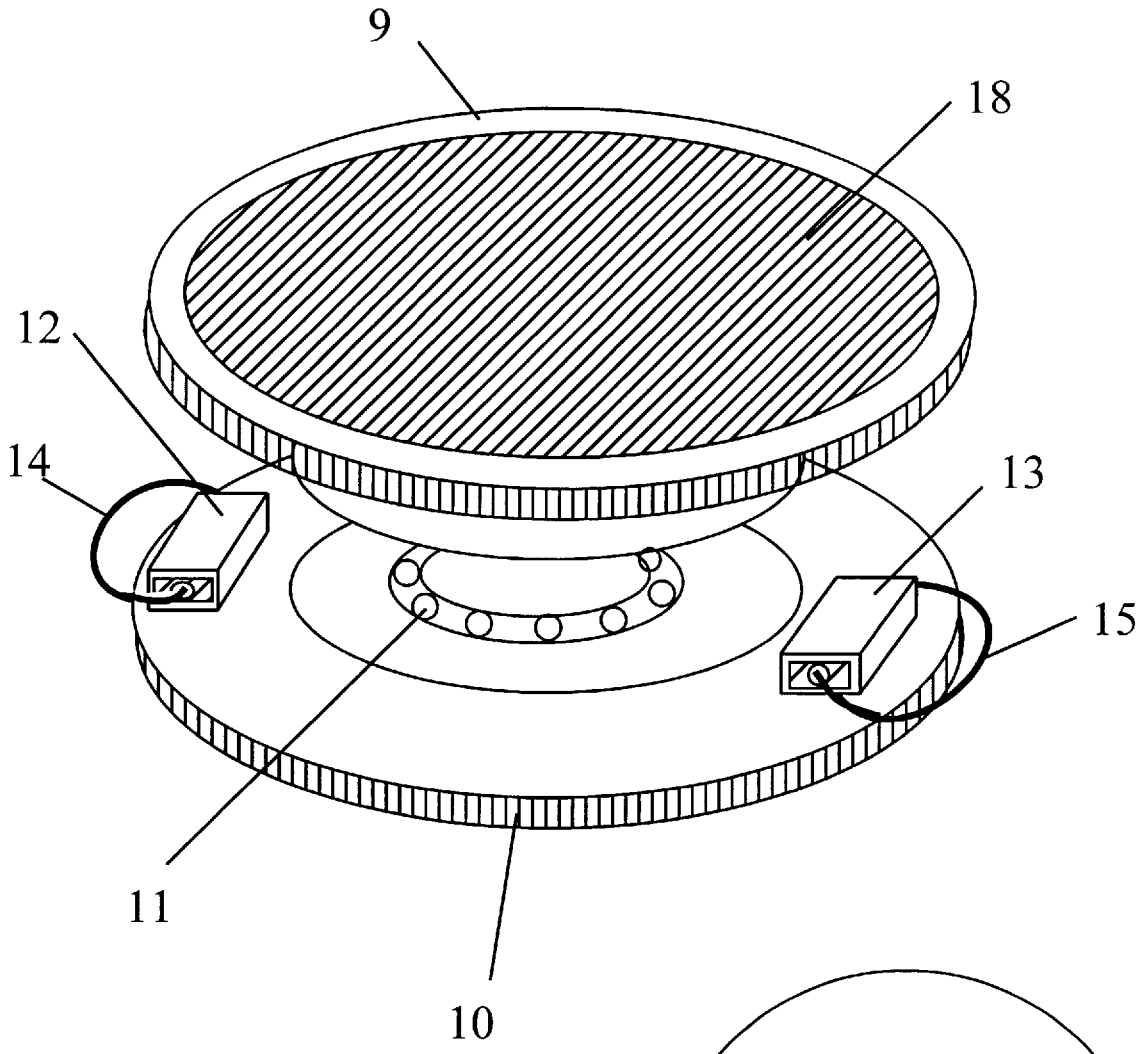
FIG. 4 is an exploded perspective view of a turning disk of the present invention.
Figure 5:
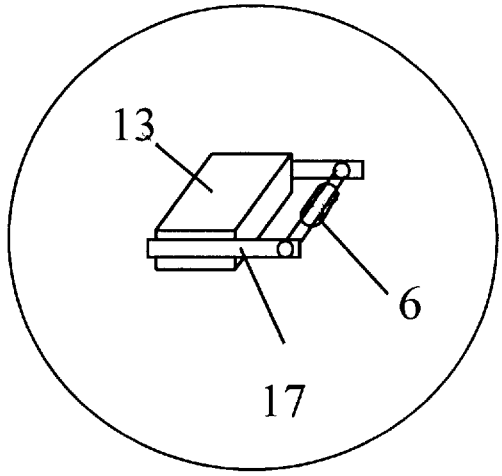
FIG. 5 is an exploded perspective view of a resistant element of the present invention.
Figure 6:
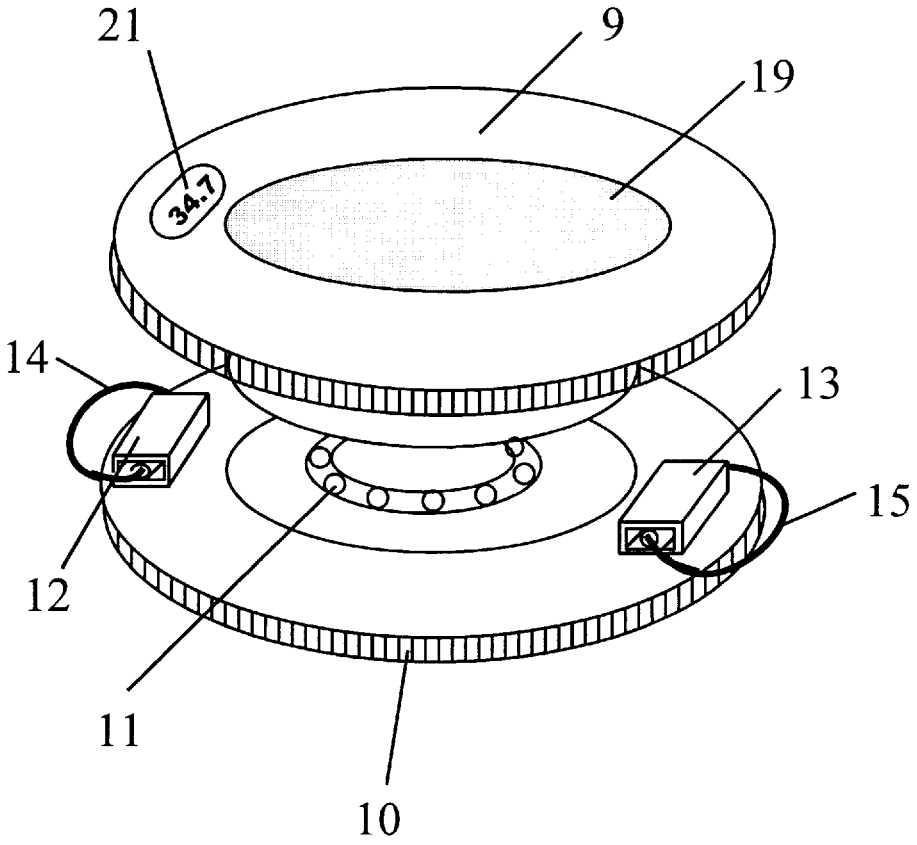
FIG. 6 is an exploded perspective view of a turning disk of the present invention with sensors and display.

Turning disks 1 and 2 mounted for rotary movements of a user 3 with respect to the base plate 4 in a manner that will be more understood from the following description (FIG. 4). Turning disk 1 or 2 consist of a cover disk 9, centrally or eccentrically mounted to a base disk 10 via bearing 11. Friction elements 12 and 13 are positioned, for example, on the base disk 10 to provide a resistance of motion of the cover disk (FIG. 5). Said friction elements 12 and 13 are provided, for example, with springs 14, 15, changes in the strength of which are used to adjust dimension of the friction elements 12, 13 (which, for example, are made from rubber or plastic). These will change the resistance of rotation of turning disks 1, 2 on which the legs of the user 3 are positioned. Bolts 16 movable united with levers 17 also can be used to adjust the dimensions of the friction elements 12, 13. An axis of said bearing 11 may coincide with axis's of cover and base disks 9 and 10, or may have an eccentric position with respect to the said axis of the disk 9 and 10. It is further understood that a coincidence or eccentricity of axes of rotation of said bearing 11 and both, the cover disk 9 and the base disk 10, may produce a different range of rotary movements of the legs of the user 3, who is positioned on one or both turning disks 1, 2. The upper part of the cover disk 9 may have anti-slip safety tread 18.

The diameters of cover disk 9 and the base disk 10 are greater than the size of a foot of a user, as particularly shown in FIGS. 1, 2, 3.

Turning disks 1 and 2 support the weight of the user 3 who imparts rotary movements with respect to the base plate 4 or the floor 6. Said cover disk 9 and base disk 10 designed preferably from plastic or wood with anti-slip safety treads 18 which are located on the side where the user's foot is positioned. The cover disk 9 may also be covered with soft or spot massage removable surfaces (not shown) united with the cover disk 9 with, for example, Velcro tape, glue, sticky labels, etc., to provide a simultaneous massage of the feet of the user positioned on the disks 1, 2 barefoot. Said massage surface may have a variety of shapes.

Turning disks 1 and 2 that are connected with base plate 4 by elements 8, allowing the base disk 10 to be motionless relative to the base plate 4. Turing disks 1 and 2 may be positioned in any place of said base plate 4. The exact location of the disk 1 or disk 2 depends on the exercise protocol, variations in age, size, and medical condition of the individual and may be easily adjusted at any time.

The cover disk 9 may have an additional figured load (not shown) united with said cover disk 9, for example with Velcro tape. Different positions of this figured load on the cover disk 9 (which change mass-inertia characteristics of the cover disk 9) may be achieved. These increase a range of rotary motion of the user's leg.

Figure 7:
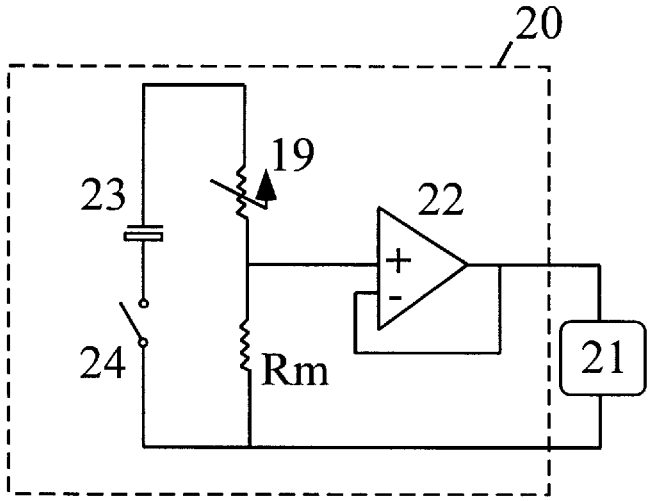
FIG. 7 is a schematic of the electronic module.

A force gauge 19 is electrically connected trough a signal-controlling circuit 20 to a display 21. The signal-controlling circuit 20 includes a measuring resistor Rm, an op-amp 22, a battery 23, and a switch 24 (FIG. 7). The force gauge (sensor) 19 may be designed as a force sensing resistor positioned in between the anti-slip safety tread 18 and the cover disk 9. It is contemplated that providing the user with information regarding his/her weight bearing can be coordinated with many types of known electrical, electronic, or electromechanical display or monitoring means.

Turning disks 1 and 2 may also be positioned on the base plate developed as a rocking board (not shown) having convexity directed to the floor or having a plank or ball on which the board is rested, providing contact with the floor 6. These will provide exercises directed to simultaneously improvement of the strength of muscles and range of motion and vestibule training. One rocking board for both disks 1 and 2 or two rocking boards for each of rotating disks 1 and 2 may be used depending on the training or rehabilitation protocol. This will provide advanced users with additional challenge.

Although it is believed that the operation of the leg exerciser of the present invention will be apparent from the above discussion, such operation will now be briefly described.

Referring to FIGS. 1, 2, and 3 exercises are performed by executing a different range of motions, which include positioning of the 3 along the base plate 4 or perpendicular to the long axis of said base plate 4, or orienting the 3 at any intermediate angle to the long axis of the base plate 4. The positions of feet of the user 3 depend on the initial positions of turning disks 1, 2 on the base plate 4 (the distance between disks influences the take leg's aside), the orientation of the base plate 4 relative to a plane of the floor 6 influences the ankle, knee and hip angles (in particular, the angle of eversion and inversion of the foot), the elevation or inclination of one of the disks influences weight bearing.

The user 3 may perform different range of rotating movements. For instance, simultaneous rhythmic rotations of both legs in a clockwise direction rather than in counterclockwise direction, and then again in clockwise direction, etc.; clockwise rotations of one leg, and opposite (counter-clockwise) rotations of another leg, etc. Different range of motion of the entire body will accompany these leg movements. Different initial orientation of turning disks 1, 2 in space provide different range of motions in the ankle, knee and hip joints. Changing the size of friction elements 12, 13 (FIG. 5) will provide variety of resistance to user's motions. Even a motionless of one of the disks 1, 2 could be achieved by using a brake mechanism (not shown) or by adjusting friction elements 12, 13.

Elevation or inclination of one of the turning disks 1, 2 will force shifting a larger portion of the weight of the user's body towards one of the legs. This will result in more symmetrical weight bearing.

Exercises may be performed while the body is straight or while a knee (knees) and upper body are flexed with a variety of combinations of angles. Exercises may be performed without any additional support, or while using stabilizing elements 25 (FIG. 2) e.g. while standing against a wall or a handle, or two handles, one or two shaft poles with or without a base, imitating a two-arm support of a skier against two skiing poles. Handrails can also be used to provide stability with the leg exerciser for those who have balance problems. A range of distance and height adjustments makes it suitable for children and adults. When exercises are performed without any additional support or with limited support, they provide significant development or improvement of balance skills.

The device may be used while standing on the turning disks 1, 2, kneeling on one disk and lean on the second disk with arms (this position, in particular, provides a wide range of exercise of the upper body in frontal plane), or sitting on a chair, couch or lounge and positioning one or two legs on one or two disks. Sitting position is particularly useful on early stage of rehabilitation for variety of patients.

Referring to FIG. 3 exercises are performed in compelled weight bearing mode while both disks 1, 2 are positioned on the base plate 4. One of the parts of the base plate 4, for example, 4*b* is positioned on the floor 6, the other part 4*a* is positioned on the support 7*a* providing an angle between the floor 6 and the disk 1. The exact angle between the plane of the floor 6 and the part 4*a* of the base plate 4 depends on desire weight shift towards the disk 2. Similar effect may be achieved when the disk 2 is positioned, for example, on the floor 6, while the other disk 1 is positioned on the elevated base plate 4 or on an additional support. The elevation of one of the leg will provide compelled shift of the body weight towards the leg positioned on the disk 2 resulting in more symmetrical weight bearing.

A particular magnitude of weight bearing may be achieved measuring a force, which the weaker leg is applied to the surface of the disk 2. As an example, a force gauge 19, which is used to measure weight of the body, applied by either leg is located in between the cover disk 9 and anti-slip safety treads 18. The exact magnitude of the force is shown by display 20. When desire weight bearing is achieved, the user performs rotating movements of one or both legs as it was described previously. Exercising in such conditions will provide the user with improved sense of normally acting leg, helping in overcoming the learned disuse of the weaker leg.

The device is easy to use and is adjustable to variations in age, size, and medical condition of the individual.

What I claim is:

1. A rotatable leg exerciser having a plurality of interactive components combined with a plurality of configurations for strengthening either one or both legs of a user comprising:

a base plate having two pivotally attached parts and underlying adjustable supports to provide a plurality of angularly distinct independent positions of each of said pivotally attached parts;

two turning disks each having a rotatable movable top part centrally mounted to a stationary lower part via a bearing means and supplied with adjustable resistance elements, said turning disks' stationary bottom part removably attached to said base plate providing a plurality of adjustment distances between said disks; and stabilizing elements to protect the user against falls;

whereby the user stands upon at least one of said turning disks for performing exercises either one or both legs.

2. A rotatable leg exerciser as recited in claim 1 wherein said rotatable movable top part is eccentrically mounted to a stationary lower part via a bearing means.

3. A rotatable leg exerciser as recited in claim 1 wherein said top part of the turning disk is supplied with an electronics module having gauges and display to measure force applied by the user's leg to the said top part of the turning disk.

4. A rotatable leg exerciser as recited in claim 1 wherein said rotatably movable top part of said turning disks are covered with one of soft and spot massage surfaces.

5. A rotatable leg exerciser as recited in claim 1 wherein said base plate and said underlying adjustable supports are covered with anti-slip safety material.

6. A rotatable leg exerciser as recited in claim 1 wherein said top part of said turning disks are supplied with brake mechanisms to lock said turning disk against rotation.

7. A rotatable leg exerciser as recited in claim 1 wherein said rotatably movable top part of said turning disk has a load removably attached thereto and is spaced from the axis of rotation of said turning disk to increase the moment of inertia of the said rotary movable top part.

8. A rotatable leg exerciser as recited in claim 7 wherein said removably attached load has a foot shaped treads.

9. A method of exercising leg muscles comprising the steps of:

providing a rotatable leg exerciser having a plurality of interactive components combined with a plurality of configurations for strengthening either one or both legs of a user, comprising:

a base plate having two pivotable attached parts and underlying adjustable supports to provide a plurality of angularly distinct independent positions of each of said pivotable attached parts;

two turning disks each having a rotatably movable top part mounted to a stationary lower part via a bearing means and supplied with adjustable resistance elements, said turning disks' stationary bottom part removably attached to said base plate for providing a plurality of distances between said disks; and stabilizing elements to protect the user against falls;

placing said base plate on the floor providing the desire angularly positions of each of said pivotable attached parts;

attaching said turning disks on said base plate with the desired distance between said disks;

a user placing both legs on each of said two said rotatably movable tops of said turning disks;

imparting rotary movements of each leg independently with respect to the said base plate by activating leg muscles;

gradually changing resistance of each of two said adjustable resistance elements, or angularly positions of each of said pivotable attached parts; or distances between said disks providing a variety of levels of strength training.

10. Method of exercising leg muscles comprising the steps of as recited in claim 9 and future including the step of placing one leg on said rotatably movable top of said turning disks while the other leg is placed on the floor or other motionless support.

11. Method of exercising leg muscles comprising the steps of:

providing a rotatable leg exerciser having a plurality of interactive components combined with a plurality of configurations for strengthening either one or both legs of a user, comprising:

a base plate having two pivotable attached parts and underlying adjustable supports to provide a plurality of angularly distinct independent positions of each of said pivotable attached parts;

two turning disks each having a rotably movable top part supplied with an electronics module having gauges and a display to measure force applied by the user's leg, said rotably movable top part mounted to a stationary lower part via a bearing means and supplied with adjustable resistance elements, said turning disks' stationary bottom part removably attached to said base plate providing a plurality of adjustment distances between said disks; and stabilizing elements to protect the user against falls;

placing said base plate on the floor providing the desire angularly positions of each of said pivotable attached parts;

attaching said turning disks on said base plate with the desired distance between said disks;

a user placing both legs on each of two said rotatably movable top of said turning disks;

measuring the force applied by legs to said rotatably movable top part of said turning disks;

achieving one of symmetrical and desired force applied to said rotatably movable top part of said turning disks by adjusting angularly distinct positions of each of said pivotable attached parts of the base plate;

imparting rotary movements of each leg independently with respect to said base plate by activating leg muscles.

gradually changing one of the resistance of each of said two adjustable resistance elements, and distances between said disks providing a variety of levels of strength training;

using stabilizing elements to protect the user against falls.

* * * * *